US007628638B2

(12) United States Patent
Wu

(10) Patent No.: US 7,628,638 B2
(45) Date of Patent: Dec. 8, 2009

(54) SHIELDED ELECTRICAL CONNECTOR WITH LATCH MEANS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/080,325

(22) Filed: Apr. 1, 2008

(65) Prior Publication Data

US 2009/0246998 A1 Oct. 1, 2009

(51) Int. Cl.
*H01R 13/627* (2006.01)

(52) U.S. Cl. ..... 439/358; 439/353

(58) Field of Classification Search ..... 439/350–353, 439/357, 358

See application file for complete search history.

(56) References Cited

U.S. PATENT DOCUMENTS

| | | | | |
|---|---|---|---|---|
| 6,257,914 | B1 * | 7/2001 | Comerci et al. | 439/357 |
| 6,454,605 | B1 | 9/2002 | Bassler et al. | |
| 6,607,397 | B1 * | 8/2003 | Zhang et al. | 439/357 |
| 6,799,986 | B2 | 10/2004 | Igarashi et al. | |
| 6,948,965 | B2 * | 9/2005 | Kumamoto et al. | 439/358 |
| 6,953,361 | B2 * | 10/2005 | Li et al. | 439/358 |
| 6,997,733 | B2 * | 2/2006 | Peng | 439/353 |
| 7,134,900 | B2 * | 11/2006 | Chung | 439/353 |
| 7,175,465 | B1 * | 2/2007 | Tsai | 439/352 |
| 7,198,522 | B1 * | 4/2007 | Ho et al. | 439/660 |
| 7,226,316 | B2 * | 6/2007 | Wu | 439/607.44 |
| 7,258,565 | B2 * | 8/2007 | Huang et al. | 439/353 |
| 7,314,383 | B1 * | 1/2008 | Ho et al. | 439/353 |
| 7,422,465 | B2 * | 9/2008 | Watanabe et al. | 439/353 |
| 7,442,066 | B1 * | 10/2008 | Ho et al. | 439/358 |
| 2005/0282424 | A1 * | 12/2005 | Huang et al. | 439/353 |
| 2006/0063415 | A1 * | 3/2006 | de Vanssay et al. | 439/350 |
| 2006/0141843 | A1 * | 6/2006 | Huang et al. | 439/350 |
| 2006/0148300 | A1 * | 7/2006 | Huang et al. | 439/353 |
| 2007/0004265 | A1 * | 1/2007 | Yeh | 439/358 |
| 2007/0049100 | A1 * | 3/2007 | Tsai | 439/352 |
| 2007/0141890 | A1 * | 6/2007 | Koyama | 439/358 |
| 2007/0141891 | A1 * | 6/2007 | Koyama et al. | 439/358 |
| 2008/0176441 | A1 * | 7/2008 | Shen et al. | 439/352 |
| 2008/0200058 | A1 * | 8/2008 | Tsai | 439/353 |

OTHER PUBLICATIONS

"DisplayPort Proposed Standard, Version 1.0" published on Dec. 6, 2005 by VESA.

* cited by examiner

*Primary Examiner*—Ross N Gushi
(74) *Attorney, Agent, or Firm*—Wei Te Chung; Andrew C. Cheng; Ming Chieh Chang

(57) ABSTRACT

An electrical connector (100) includes a first metal part (1*a*) defining a shrouded mating interface (110) having a top surface, and a first rear portion (12); a second metal part (1*b*) accommodated in the first metal part (12) and having a second rear portion (13) jointly defining a receiving space with the first rear portion; an insulated housing (2) along with terminals (3) received in the shrouded mating interface; and at least a latch member (136) integrally formed with one of the first and second metal part and extending into the shrouded mating interface, and a hook (1365) formed on a free end of the latch member, and extending through the top surface of the shrouded mating interface, and retracted into the shrouded mating interface when external force is applied.

17 Claims, 6 Drawing Sheets

SHIELDED ELECTRICAL CONNECTOR WITH LATCH MEANS

CROSS-REFERENCE TO RELATED APPLICATION

This application is related to U.S. patent application Ser. No. 11/891,795, filed on Aug. 13, 2007 and entitled "CABLE CONNECTOR WITH ANTI CROSS TALK DEVICE", and it has the same applicant and assignee as the present invention. The disclosure of the related application is incorporated herein by reference.

FIELD OF THE INVENTION

The present invention generally relates to an electrical connector, and more particularly to a shielded electrical connector used in high-speed signal transmission.

DESCRIPTION OF PRIOR ART

In recent years, human has benefited much from the fast developing digital industry. The digital industry brings us a multiply of products, such as personal computer (PC) and consumer electronic (CE) products including TV, DVD player, game console, etc. Usually, either PC or CE product has a display device for showing video, and a cable connector is needed to connect an interface of the display and a control device. A display port connector may be an ideal I/O port adapted for both PC and CE product.

As such kind of display connector is used for high-speed transmission, and Electro-Magnetic Interference (EMI) often occurs around a connector mating interface, which may seriously interfere correct signals. Thus, an electrical connector is usually shielded by an outer sheet metal to avoid EMI.

To ensure the signal being transmitted continually without interrupted by unforeseen incident, locking means is often applied to the electrical connector. U.S. Pat. No. 6,799,986 issued to Igarashi discloses a type of shielded connector with locking means thereof.

The aforementioned connector comprises a connector body, a shell and two latch members. Each of the latch members includes a latch projection formed on one end thereof in the Y direction. The latch projections project from an inside of the shell through openings of the shell. The latch projection further comprises a plate portion and a bulged portion, which is formed on the plate portion and serves as a control point for movement of the latch projection. The shell further comprises two apertures, each of which has a first area size. The plate portion has a second area size larger than the first area size while the bulged portion has a third area size smaller than the first area size. The plate portion is arranged on the inside surface of the shell to block the corresponding aperture under the normal conditions, while the bulged portion is surrounded by the corresponding aperture of the shell under the normal conditions. Therefore, the bulged portion is touchable from the outside of the shell. At the outside of the shell, buttons will be arranged so as to be able to exert forces on the bulged portions when the buttons are operated. When the bulged portions are pressed, the latch projections will be retracted to the inside the shell.

The locking members of the aforementioned electrical connector is so complex that it is difficult to manufacture and assemble this kind of electrical connector.

Hence, an improved shielded electrical connector with latch means is highly desired to overcome the aforementioned problems.

SUMMARY OF THE INVENTION

Accordingly, an object of the present invention is to provide a shielded electrical connector having a latch means.

In order to achieve the object set forth, an electrical connector in accordance with the present invention comprises a first metal part defining a shrouded mating interface having a top surface, and a first rear portion; a second metal part accommodated in the first metal part and having a second rear portion jointly defining a receiving space with the first rear portion; an insulated housing along with contact terminals received in the shrouded mating interface; and at least a latch member integrally formed with one of the first and second metal part and extending into the shrouded mating interface, and a hook formed on a free end of the latch member, and extending through the top surface of the shrouded mating interface, and retracted into the shrouded mating interface when external force is applied.

Other objects, advantages and novel features of the invention will become more apparent from the following detailed description when taken in conjunction with the accompanying drawings.

DETAILED DESCRIPTION OF PREFERRED EMBODIMENTS

Figure 1:
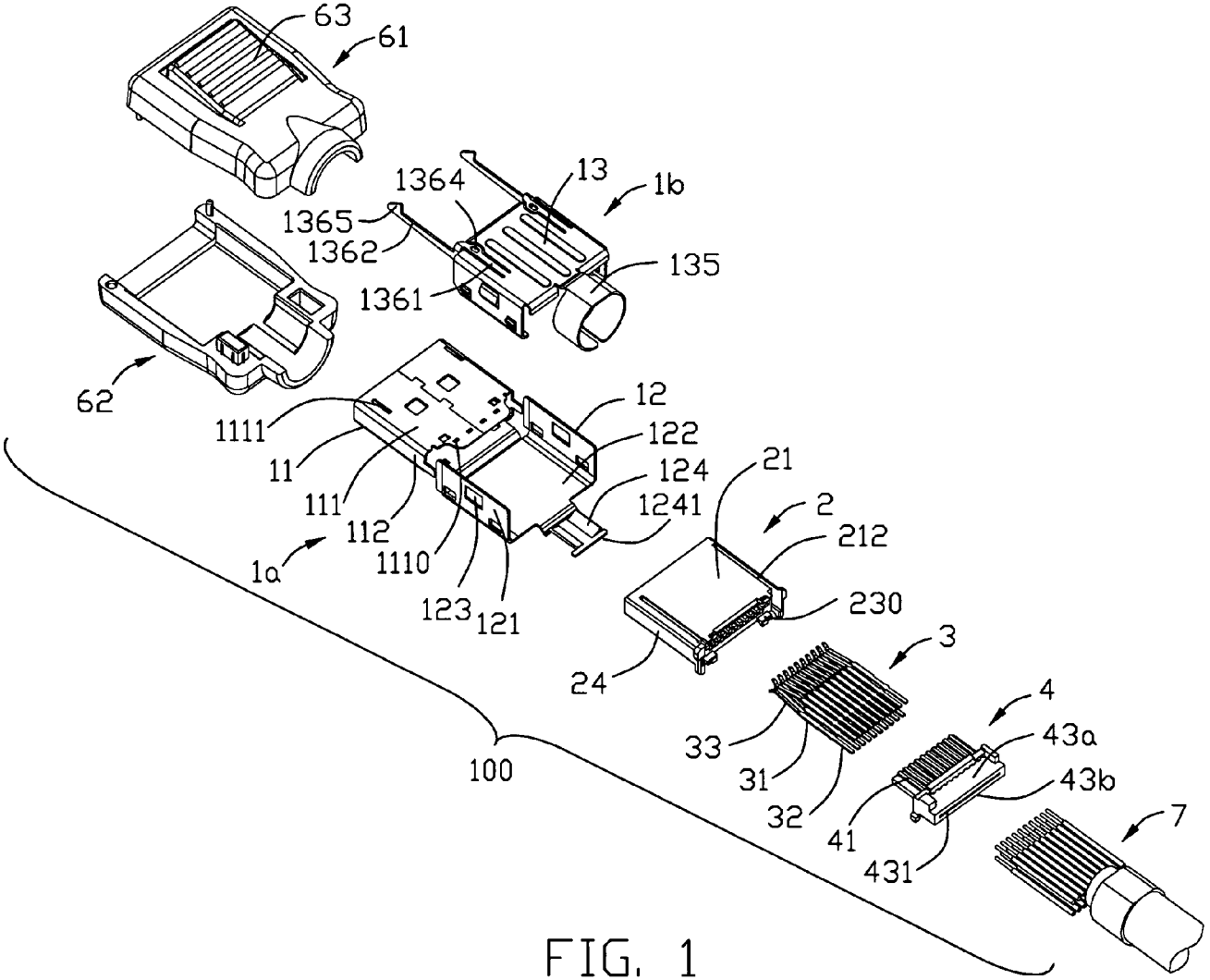
FIG. 1 is an exploded, perspective view of a cable connector in accordance with the present invention.
Figure 2:
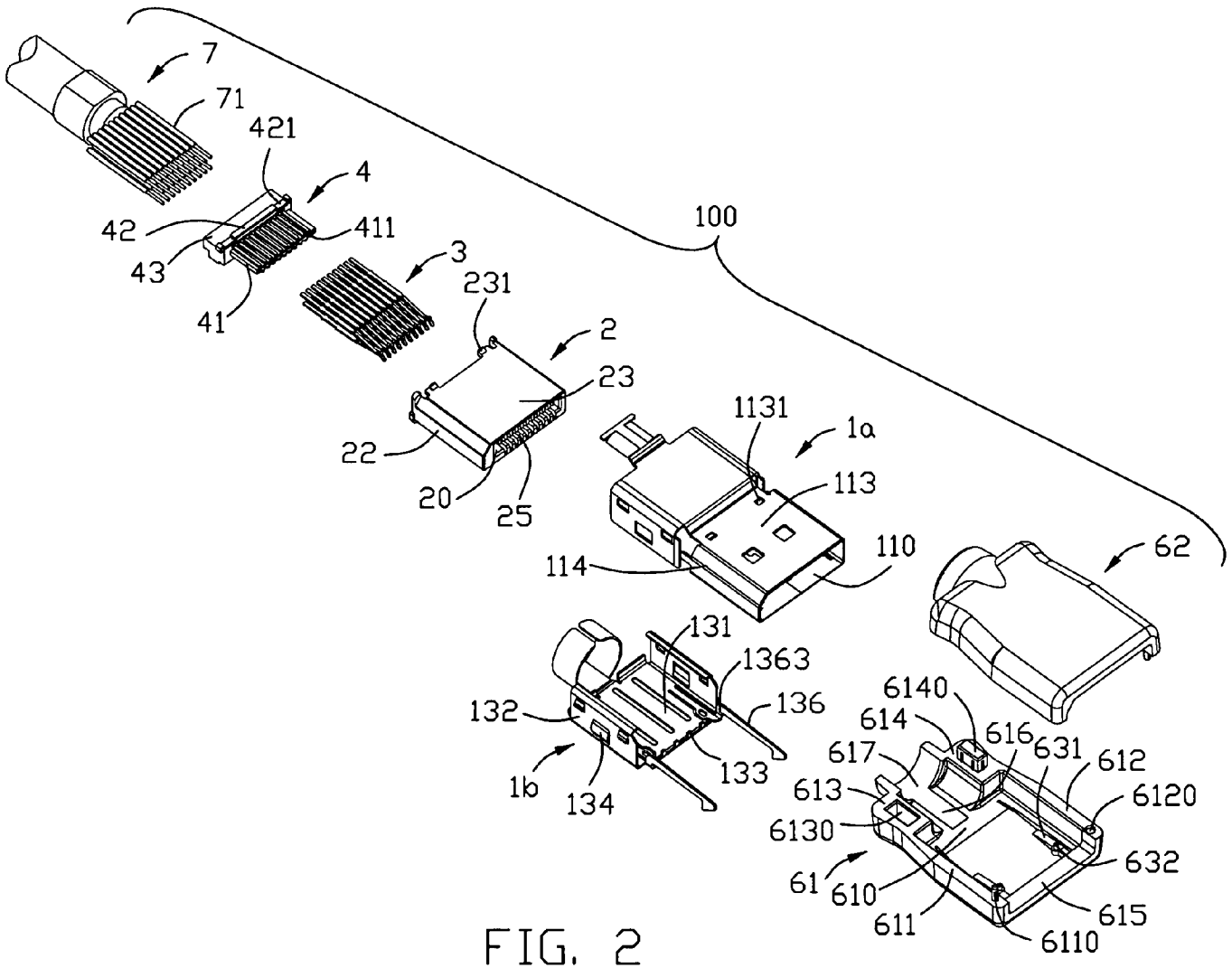
FIG. 2 is similar to FIG. 1, but viewed from another aspect.

Reference will now be made in detail to the preferred embodiment of the present invention.

Referring to FIGS. 1-6, a cable connector 100 in accordance with the present invention comprises a metal shell 1 with a pair of latch members 136 integrally formed thereon, a plurality of terminals 3 along with an insulated housing 2 enclosed within the metal shell 1, a cable 7 having a number of wires 71 respectively electrically joining to the terminals 3, and a cover 6 partially shrouding the metal shell 1.

The metal shell 1 comprises a first shield part 1*a* and a second shield part 1*b*. The first shield part 1*a* includes an enclosing portion 11 which consists of a top side 111, an opposite bottom side 113, and a pair of transversal sides 112, 114 interconnecting the top and bottom sides 111, 113 to form a shrouded mating interface 110 for receiving the insulated housing 2. A front section of the top side 111 defines a pair of latch holes 1111 arranged at lateral sides thereof. A rear section of the top side 111 defines four holes 1110 therein and a pair of apertures (not numbered) in front of the four holes 1110. And the rear section of the bottom side 113 also has a pair of apertures 1131 opposite to the pair of apertures in the top side 111. The first shield part 1*a* further includes a U-shaped first rear portion 12 rearward extending from the bottom side 113 of the enclosing portion 11. The first rear portion 12 includes a flat board portion 122 and a pair of upright sides 121 joining to lateral edges of the flat board portion 122. The first rear portion 12 further has a sheet stretching portion 124 being slightly bent to arched configuration and extending rearward from middle end edge of the flat board portion 122, and a free end of the stretching portion 124 further forms a flat stopper 1241. Each upright side 121 defines three locking holes 123 with different sizes and arranged along mating direction.

The second shield part 1*b* includes an inverted U-shaped second rear portion (main portion) 13 and a cylindrical-shaped cable holder 135 connecting thereto. The second rear portion 13 also includes a planar top side 131 and a pair of upright sides 132 joining to lateral edges of the top side 131. The second rear portion 13 is stamped of a metal sheet, with the pair of latch members 136 integrally formed with the top side 131. Each latch member 136 includes a horizontal segment 1361 and a cantilevered segment 1362, interconnected by an L-shaped transition segment 1363. The horizontal segment 1361 is substantially a part of a top side 131 of the second metal part and lies at a first imaginary level. The horizontal segment 1361 is transversally discrete from other part of the top side 131, with a pair of slits (not numbered) interposed therebetween. The transition segment 1363 firstly extends outward from front end of the horizontal segment 1361 and then is bent downward. The cantilevered segment 1362 extends forwardly from front end of the transition segment 1363 and lies at a second imaginary level, lower than the first imaginary level. A distance between the pair of the cantilevered segment 1362 is larger than a distance between the pair of the horizontal segment 1361. A pair of hook portions 1365 are formed at free ends of the pair of the cantilevered segments 1362, respectively. Each upright sides 132 forms three locking tab 134 with different sizes corresponding to the locking holes 123 of the upright side 121 of the U-shaped first cover portion 12, and the forward edge of the board portion 131 further forms four tabs 133 thereon. The first rear portion 12 accommodates the second rear portion 13 to define a receiving space (not numbered) therebetween.

The insulated housing 2 comprises a top wall 21, an opposite bottom wall 23, and a pair of side walls 22, 24 connecting with the top and the bottom walls 21, 23 to form a hollow portion 20. Both the top wall 21 and the bottom wall 22 defines a plurality of terminal passages 25 arranged in two distinct rows and offset from each other respectively. The rear portion of the bottom wall 23 forms two spaced apart protruding portions 230, and each of the protruding portions 230 has a tapered tip 231 thereon. And the rear portion of the top wall 21 also forms a pair of protruding portions (not labeled) opposite to the protruding portions 230 and each has a tapered tip thereon. A pair of slots 212 are recessed downward from surface of the top wall 21 and arranged in lateral sides thereof.

Figure 6:
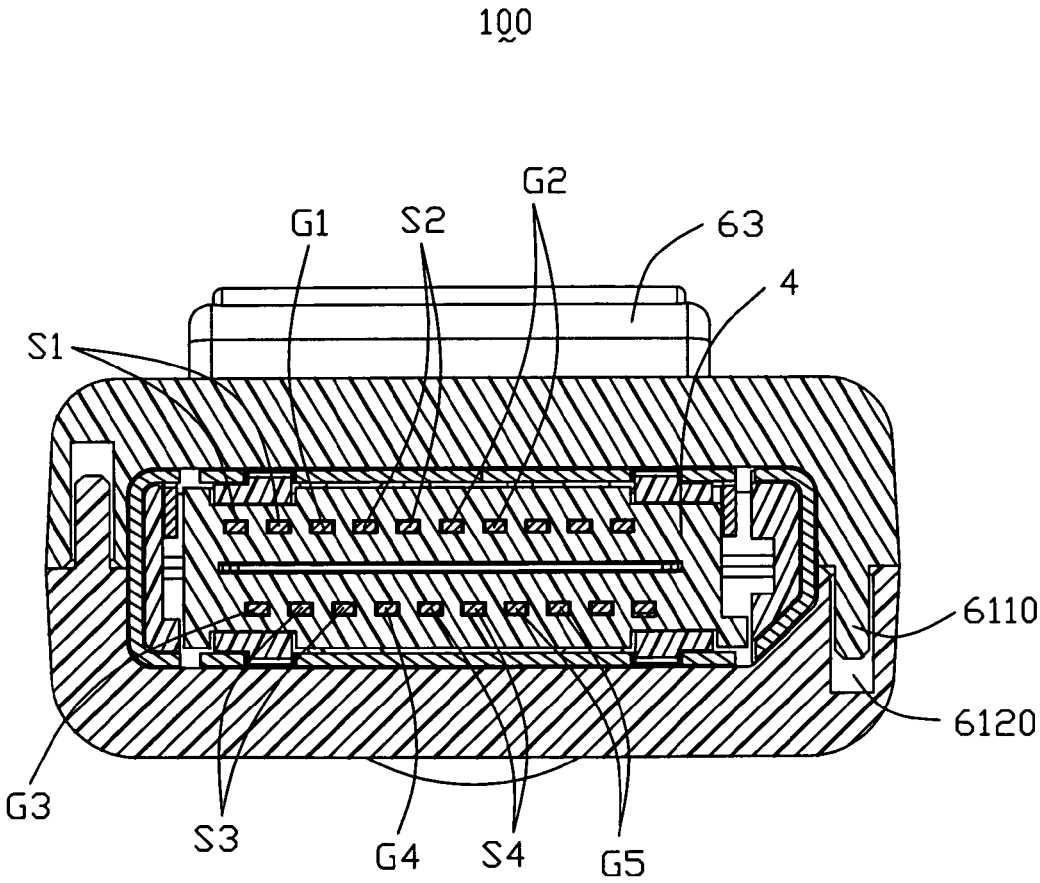
FIG. 6 is a cross-section view of FIG. 3 taken along line 6-6.

Each terminal 3 with identical configuration includes a flat body portion 31, a curved mating portion 33 extending forward from a front end of the body portion 31, and a flat termination portion 32 extending rearward from a rear end of the body portion 31. The terminals 3 are separated into an upper terminal row and an opposite lower terminal row. Referring to FIG. 6, both the upper terminal row and the lower terminal row have two pairs of differential signal terminal pairs S1, S2 and S3, S4. The differential signal terminal pairs S1, S2 are offset from the differential signal terminal pairs S3, S4 along vertical (up-to-down) direction. The upper terminal row further includes two groups of first grounding terminals G1, G2 to space the differential signal terminal pairs S1, S2 along horizontal direction. The lower terminal row also has three groups of grounding terminals G3, G4, G5 being spaced by the pair of differential signal terminal pairs S3, S4. Each of the differential signal terminal pairs S1-S4 together with one of directly facing grounding terminals G1-G5 consist of a triangular-shaped terminal group viewed from mating direction, such as S1 and G3, S3 and G1, and so on.

Figure 3:
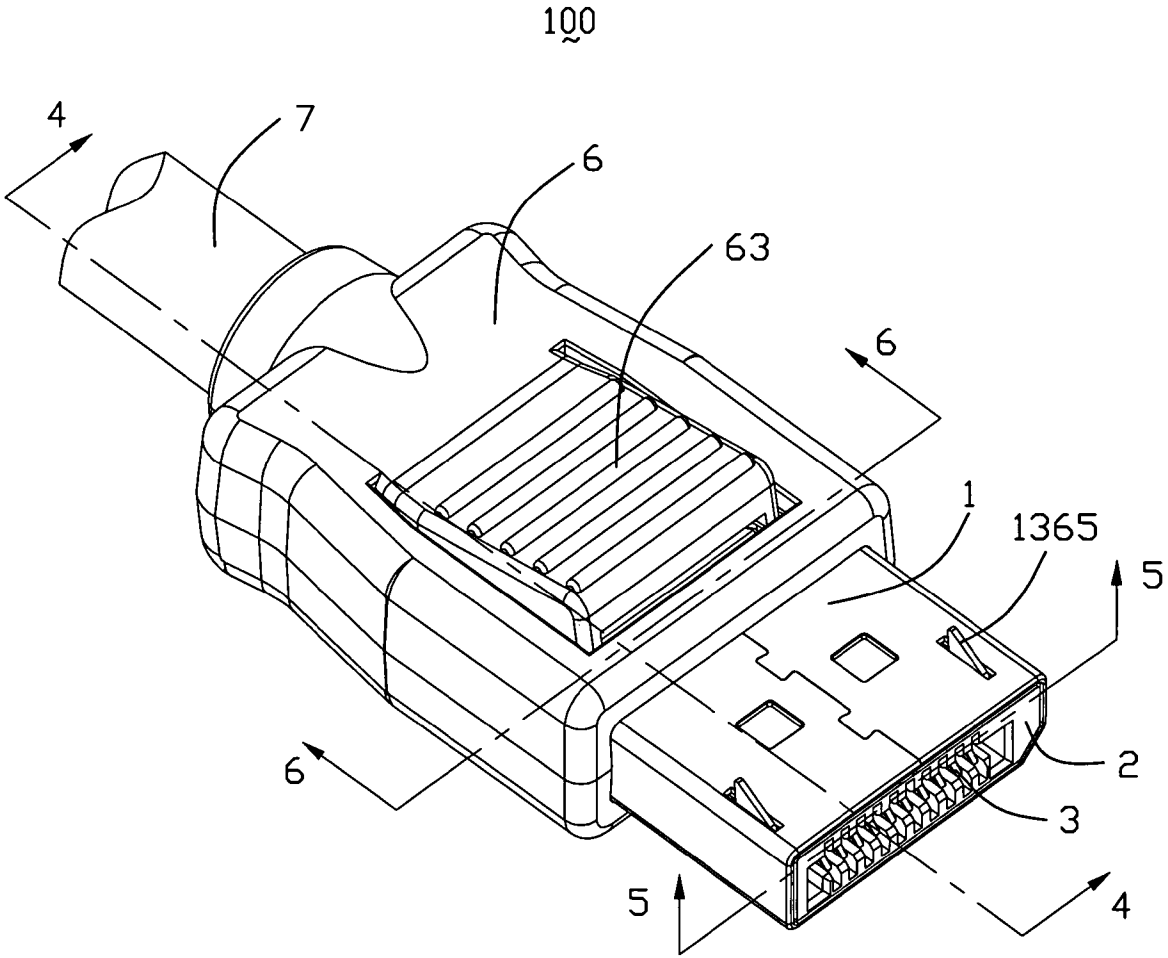
FIG. 3 is an assembled, perspective view of the cable connector.
Figure 4:
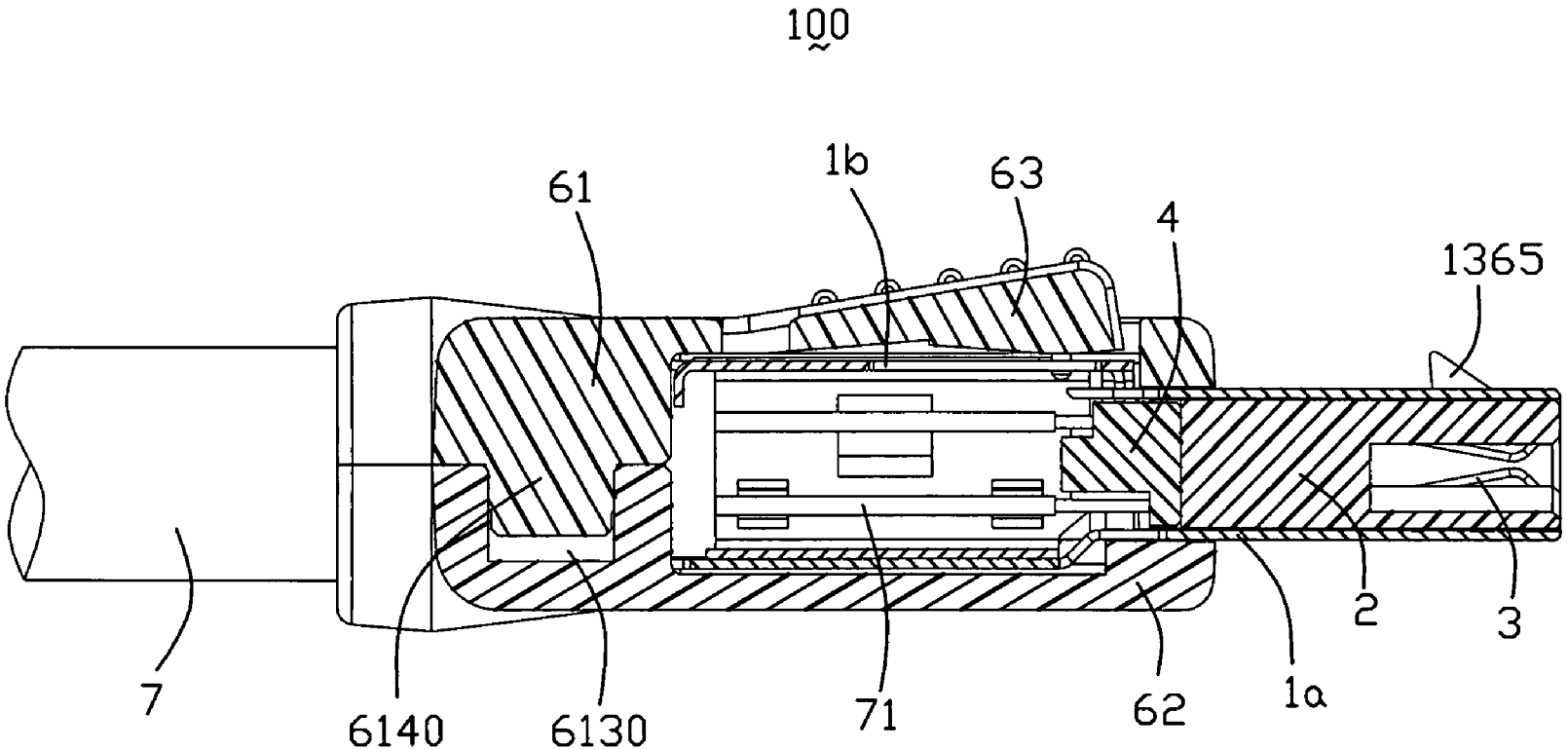
FIG. 4 is a cross-section view of FIG. 3 taken along line 4-4.
Figure 5:
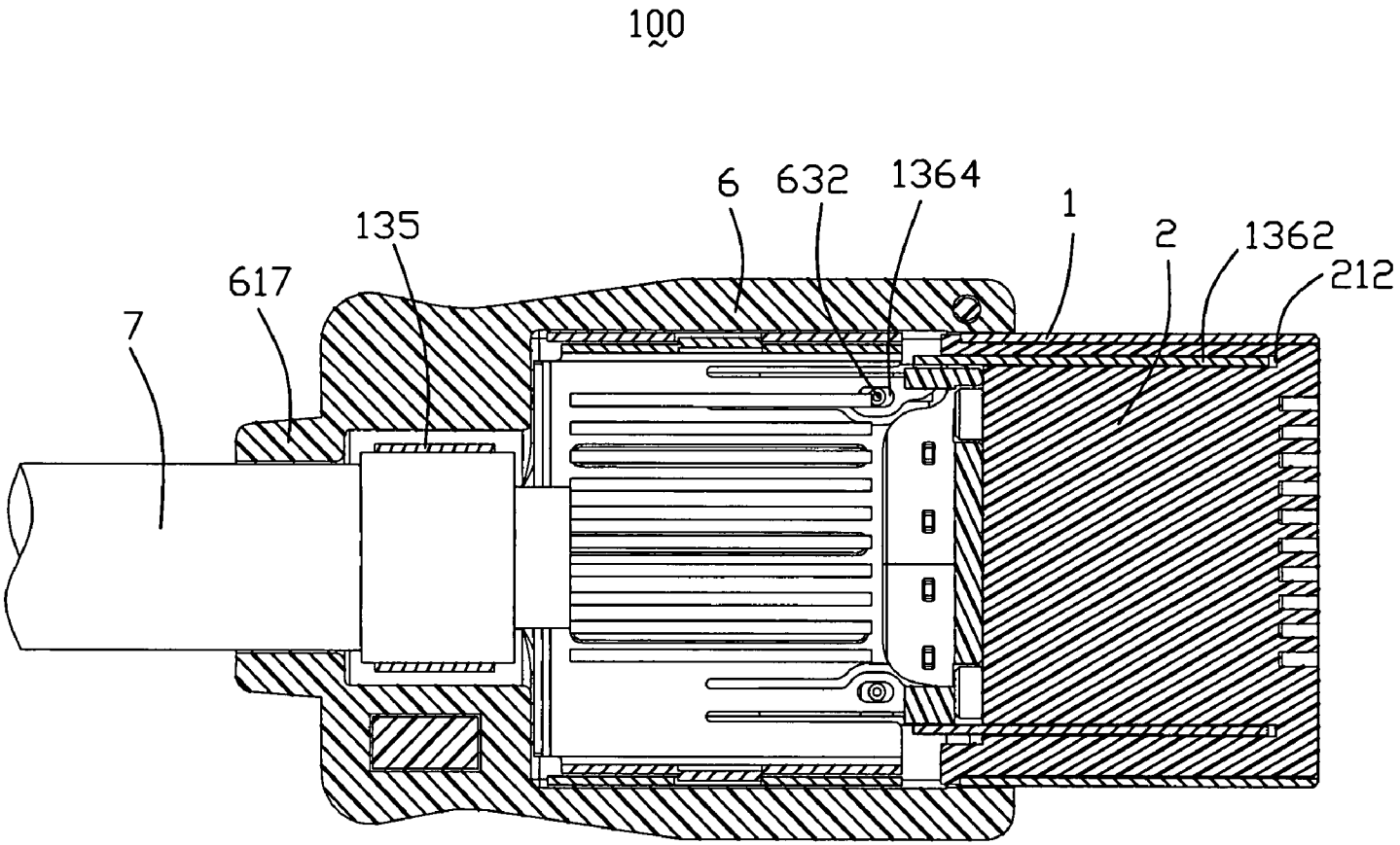
FIG. 5 is a cross-section view of FIG. 3 taken along line 5-5.

The terminal organizer 4 comprises a base portion 43 and a tongue portion 41 extending forwardly from a front edge of the base portion 43. The base portion 43 defines a rectangular-shaped gap 431 (FIG. 4) which divides the base portion 43 into an upper wall 43*a* and a lower wall 43*b* (FIG. 3). A pair of flange portions 42 is proximate to the tongue portion 41 and respectively extend outwardly from surfaces of the upper wall 43*a* and the lower wall 43*b*. Each flange portion 42 has a pair of cutouts 421 adjacent to transversal sides thereof. An upper portion and a lower portion of the tongue portion 41 define a plurality of terminal slots 411 arranged in a row by side-to-side manner, and the flange portions 42 also define a plurality of through holes (not numbered) and each through hole aligns with corresponding terminal slot 411.

The cover 6 has an up cover 61 and a low cover 62. The up cover 61 includes a pair of side walls 611, 612, a back wall 613 to cooperate a first receiving space 610 therebetween. The first receiving space 610 is used for accommodating partial of the metal shell 1. A button 63 is deflectable to and integrally formed with the up cover 61. Two bulged members 631 are arranged on a bottom surface of the button 63 and spaced apart one another. Each bugled member 631 further has a tiny post 632 extending downward from a bottom surface of the bulged member 631. A front segment of the up cover 61 defines an outlet 615 which is narrower and shallower than the first receiving space 610. A semi-circular shaped cavity 616 is defined in the back wall 616 and a semi-cylindrical shaped cable supporter member 617 is disposed backward of and communicates with the cavity 616. The radial dimension of the cavity 616 is larger than that of an interior of the cable supporter member 617. The cavity 616 is adapted for retaining the cable holder 135 and the cable supporter is used for holding the cable 7. A position post 6110 is located on a front section of the side wall 611 and a receiving hole 6120 is defined in a front section of the side wall 612 too. A retention member 6140 extends downward from surface of the back wall 614 and a retention cavity 6130 is recessed upward from surface of the back wall 613. Both position post 6110 and retention member 6140 have some tiny ribs (not numbered) thereon. The low cover 62 is substantially same as the upper cover, except for the button 63, and detailed description thereof is omitted. The position post 6110 and retention member 6140 of the up cover 61 are press fit a receiving hole and retention cavity (not numbered) of the low cover 62, and the position post and retention member (not numbered) of the low cover 62 are also press fit a receiving hole 6120 and retention cavity 6130 of the up cover 61.

When assembly, firstly, the terminals 3 are arranged on the terminal organizer 4, with the mating portions 33 extending beyond a front end of the tongue portion 41, the body portions 31 located in the terminal slots 411 of the tongue portion 41, the termination portion 32 via the through holes of the flange portions 42 and disposed on the up and the bottom surfaces of the base portion 43. Secondly, the terminals 3 and the terminal organizer 4 together are assembled to the insulated housing 2 till the flange portions 42 of the terminal organizer 4 abuts against rear edge of the insulated housing 2, with the mating portions 33 of the terminals 3 received in the terminal passages 25 of the insulated housing 2, the tongue portion 41 of the terminal organizer 4 received in the hollow portion 20 of the insulated housing 2, the base portion 43 of the terminal organizer 4 disposed outside the rear portion of the insulated housing 2, and the protruding portions 230 of the insulated housing 2 laid in the cutouts 421 of the flange portions 42 of the terminal organizer.

Thirdly, the wires 71 of the cable 7 are respectively soldered to the termination portions 32 of the terminals 3. Fourthly, the insulated housing 2 is wrapped by the enclosing portion 11 of the first shield part 1*a* of the metal shell 1, with the pair of tips 231 of the two protruding portions 230 inserted into the pair of apertures 1131 of top side 113 of the enclosing portion 11, simultaneously, the base portion 43 of the terminal organizer 4 and the exposed wires 71 are disposed in a rectangular space (not numbered) of the first rear portion 12 of the metal shell 1. Then the second shield part 1*b* is assembled to the first shield part 1*a*, with the cantilevered segments 1362 of the pair of latch members 136 inserted into and held by the pair of slots 212 of the insulated housing 2, respectively, the pair of hook portions 1365 upward protruding outward through the pair of latch holes 1111, the tabs 133 of the board portion 131 penetrating into corresponding holes 1110 of the top side 111, the locking tabs 134 of the upright sides 132 of the lower second shield part 1*b* locked into the locking holes 123 of the upright sides 121 of the first shield part 1*a*, then the cable holder 135 crimped to an end of the cable 7 and the stretching portion 124 of the first shield portion 1*a*, with the flat stopper 1241 of the stretching portion 124 abutting against a rear edge thereof. Fifthly, the up cover 61 and the low cover 62 are assembled together to hold the metal shell 1, with tiny posts 632 passing through holes in the horizontal segments 1361 of the pair of latch members 136, the pair of bulged members 631 abut against the horizontal segments 1361 of the pair of latch members 136.

When the electrical connector 100 disengages with a complementary connector, just press the button 63 to urge the pair of hook portions 1365 of the latch members 136 retracting into the shrouded mating interface 110 of metal shell 1, and a pull force is exerted to the electrical connector to make it unplug the complementary connector. The present invention is ingenious, as the latch members 136 is directly manufactured by stamping process with the metal shell 1 and together assembled to the electrically connector 100, without additional manufacturing process for assembling latch members 136.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A shielded electrical connector, comprising:

a first metal part defining a shrouded mating interface having a top surface, and a first rear portion;

a second metal part accommodated in the first metal part and having a second rear portion jointly defining a receiving space with the first rear portion;

an insulated housing along with terminals received in the shrouded mating interface; and at least a latch member integrally formed with one of the first and second metal part and extending into the shrouded mating interface, and a hook formed on a fire end of the latch member, and extending through the top surface of the shrouded mating interface, and retracted into the shrouded mating interface when external force is applied.

2. The shielded electrical connector as recited in claim 1, wherein the latch member is integrally formed with the second rear portion of the second metal part.

3. The shielded electrical connector as recited in claim 2, wherein the latch member includes a horizontal segment and a cantilevered segment, interconnected by a transition segment, wherein the horizontal segment lies at a first level and the cantilevered segment lies at a second lever, lower than the first lever.

4. The shielded electrical connector as recited in claim 3, wherein the horizontal segment is substantially a part of a top side of the second metal part and laterally discrete from other part thereof.

5. The shielded electrical connector as recited in claim 3, wherein the transition segment is of L-shaped.

6. The shielded electrical connector as recited in claim 5, wherein a distance between pair of cantilevered segments is larger than a distance between pair of horizontal segments of the pair of latch members.

7. The shielded electrical connector as recited in claim 3, wherein the insulated housing defines a pair of slots holding the cantilevered segments of the pair of latch members, respectively.

8. The shielded electrical connector as recited in claim 3, wherein a cover encloses the first metal part and the second metal part.

9. The shielded electrical connector as recited in claim 8, wherein the cover includes an upper cover part and a lower cover part, wherein a button is arranged on the upper cover to actuate the latch member.

10. The shielded electrical connector as recited in claim 9, wherein a bulged member is arranged on a bottom surface of the button and abut against the horizontal segment of the latch member.

11. The shielded electrical connector as recited in claim 10, wherein a tiny post extends downward from a bottom surface of the bulged member and is inserted through a hole defined in the horizontal segment of the latch member.

12. The shielded electrical connector as recited in claim 1, wherein a contact terminal organizer is assembled to rear portion of the insulated housing.

13. The shielded electrical connector as recited in claim 12, wherein the terminal organizer includes a base portion supporting rear portions of the terminals and a tongue portion inserted into a cavity of the insulated housing.

14. The shielded electrical connector as recited in 13, wherein a cable having plurality of conductive wires is terminated to the rear tail portions of the terminals through the organizer.

15. The shielded electrical connector as recited in 14, wherein the terminal organizer is received in the receiving space defined by the first metal part and the second metal part.

16. The shielded electrical connector as recited in claim 14, wherein the second metal part is integrally formed with a strain relief holding the cable.

17. The shielded electrical connector as claimed in claim 1, wherein the terminals are separated into distinct sets.

* * * * *